United States Patent [19]

Andres

[11] Patent Number: 4,869,020

[45] Date of Patent: Sep. 26, 1989

[54] WINDOW ASSEMBLY HAVING A WINDOW LATCH CONSTRUCTION

[75] Inventor: Thomas Andres, North Versailles, Pa.

[73] Assignee: Thermal Industries, Inc., Pittsburgh, Pa.

[21] Appl. No.: 147,952

[22] Filed: Jan. 25, 1988

[51] Int. Cl.[4] ..... E05D 15/22

[52] U.S. Cl. ..... 49/161; 49/174; 49/454

[58] Field of Search ..... 49/161, 174, 194, 454, 49/453

[56] References Cited

U.S. PATENT DOCUMENTS 583,004 5/1897 Stothart ..... 49/174
602,245 4/1898 Schmitz ..... 49/174
3,153,818 10/1964 Osten, Sr. ..... 49/174
3,452,478 7/1969 Foster ..... 49/161

*Primary Examiner*—Philip C. Kannan
*Attorney, Agent, or Firm*—Arnold B. Silverman

[57] ABSTRACT

A window assembly having a window latch construction is disclosed. The window assembly comprises a window frame having parting bead mounted therein and a window sash having mounted thereon a parting bead cam rotatable from a first position to a second position. When the parting bead cam is in a first position, the window sash can slide vertically with respect to the window frame. When the parting bead cam is in a second position, the window sash can tilt angularly with respect to the window frame.

13 Claims, 2 Drawing Sheets

WINDOW ASSEMBLY HAVING A WINDOW LATCH CONSTRUCTION

BACKGROUND OF THE INVENTION

1. Field Of The Invention

This invention relates to a window assembly having a window latch construction and more specifically to a parting bead cam that is mounted on a window sash that is adapted to be both vertically slidable and inwardly rotatable with respect to a window frame.

2. Description Of The Prior Art

It has been known to make windows having movable sashes made of wood, aluminum, or vinyl. The sashes may be arranged in such a manner that an upper sash and a lower sash may not only slide vertically to open the window, but also may tilt or pivot into the house or building to facilitate cleaning the window. See, e.g., U.S. Pat. Nos. 3,462,882; 4,068,406; 4,144,674; and 4,525,952.

Tilting of the window sash inwardly may be accomplished by various means and the window may include a lock. For example, U.S. Pat. No. 4,525,952 discloses a tiltable window having a locking mechanism consisting of a slot, locking arm, pin and handle.

U.S. Pat. No. 4,144,674 discloses parting strips which are pushed back against the bias of springs into accommodating recesses to facilitate tilting of the windows. The parting strips are each held in position by detents.

U.S. Pat. No. 4,068,406 discloses a balance spring assembly positioned in the channel of the weather stripping in a sash. The spring assembly consists of a block with a shaft member extending therethrough. Also positioned on the block are camming members which rotate and engage a flat surface on the shaft member.

U.S. Pat. No. 3,462,882 discloses a camming bead formed on a pivot member which provides a guide for the sash during normal raising and lowering and locking pressure when the sash is tilted.

Despite the above devices, there remains a need for a window latch construction that is easily manufactured and easy to use and which provides an effective and reliable locking mechanism when the window sash is moved vertically and tilted inwardly in the window frame.

SUMMARY OF THE INVENTION

The window latch construction of the present invention has met the above-mentioned need.

The window assembly has a window latch construction which comprises a window frame having parting bead means mounted therein, and a window sash, mounted in a window frame, the window sash having mounted thereon a parting bead cam means rotatable from a first position to a second position, whereby when the parting bead cam means is in a first position the window sash can slide vertically with respect to the window frame and when the parting bead cam means is in a second position, the window sash can tilt angularly with respect to the window frame.

It is an object of the invention to provide a window latch construction that enables a window sash to alternately move vertically in the window frame and be tilted inwardly with respect to the window frame.

It is a further object of the invention to provide a parting bead cam that is mounted on a movable window sash.

It is a further object of the invention to provide a parting bead cam that is dependable and easy to use.

It is a further object of the invention to provide a parting bead cam which is designed so that it is easy to determine visually whether the window sash can be moved vertically or tilted inwardly.

It is a further object of the invention to provide a window latch construction that is easy to manufacture.

It is a further object of the invention to provide a parting bead cam and parting bead which allows a window sash to be locked or tilted at any height position in the window frame.

These and other objects of the invention will be more fully understood from the following description of the invention on reference to the illustrations appended hereto.

DESCRIPTION OF THE PREFERRED EMBODIMENT

Referring now to FIGS. 1–4, a partial view of a window assembly 20, which is comprised of an elongated main window frame 22 and a window sash 24, is shown. The window frame 22 preferably is of generally rectangular configuration and has four frame sections. It is preferably an elongated extrusion made of vinyl and can be designed in any size or shape. The window sash 24 is designed to have a panel, in this case a window pane 26, secured therein. The window sash 24 of the present invention is both slidable vertically in the window frame 22 and tiltable inwardly with respect to the window frame 22. This point will be discussed in detail hereinbelow.

Figure 1:
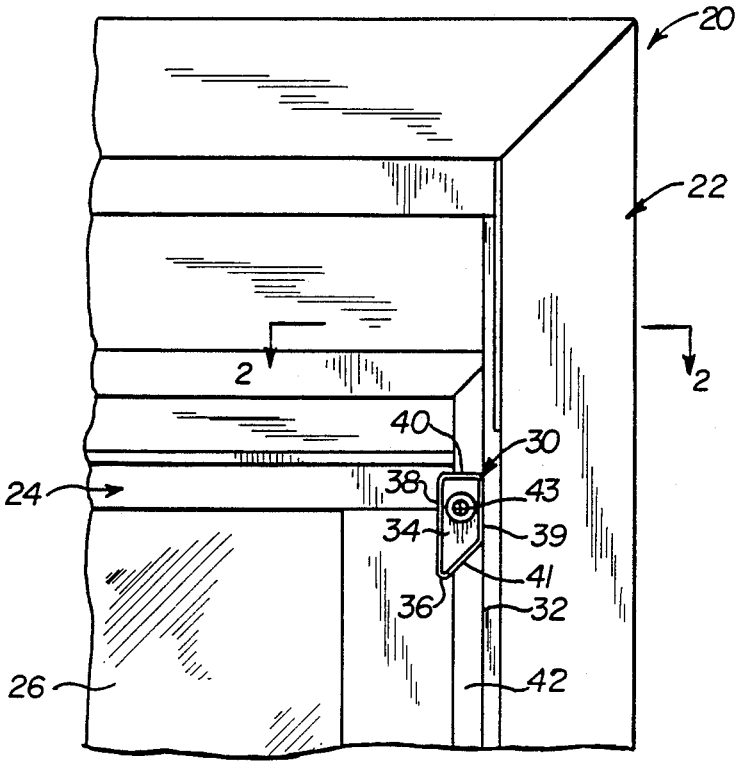
FIG. 1 is a partial front elevational view of a window sash in a window frame showing the parting bead cam of the invention released position.

The parting bead means 30 of the invention consists of a parting bead 32 mounted in the window frame 22 and a parting bead cam 34 mounted on the window sash 24. As can be seen in FIG. 1, the parting bead cam 34 is preferably generally trapezoidal in shape with preferably one end converging to a point 36. The parting bead cam 34 has two parallel sidewalls 38 and 39, an endwall 40 that is perpendicular to both sidewalls 38 and 39 and a generally angled endwall 41 that joins sidewalls 38 and 39 to form the general trapezoidal shape of the parting bead cam 34. Preferably, when point 36 is pointing downwardly, parting bead cam 34 is not engaging the parting bead 32, as shown in FIG. 1. When the point 36 is pointing to the side as shown in FIG. 3, the parting bead cam 34 is engaging the parting bead 32.

The design of the parting bead cam 34 facilitates ready visual determination of whether the parting bead cam 34 is in the "released" or "depressed" position. These terms will be explained hereinbelow.

Figure 2:
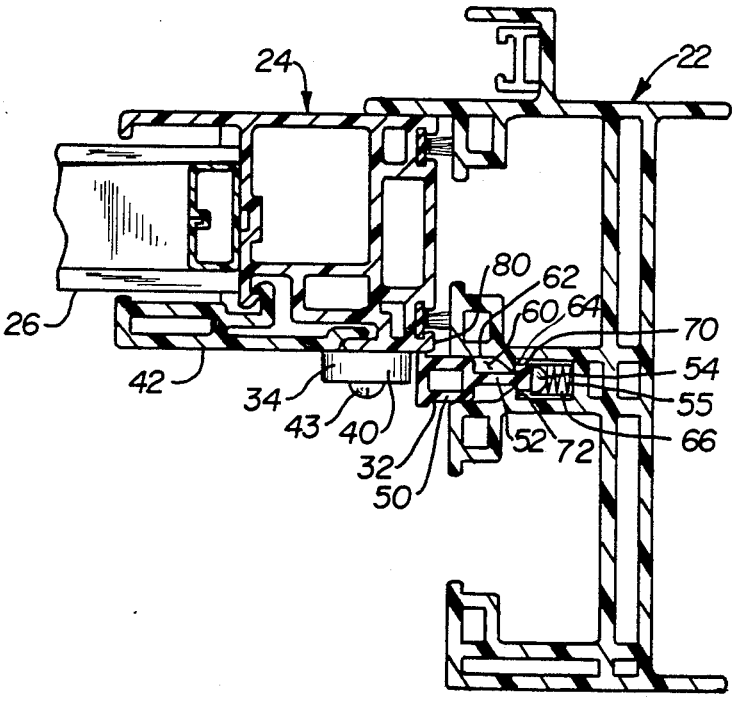
FIG. 2 is a cross sectional view taken along line 2—2 of FIG. 1.
Figure 4:
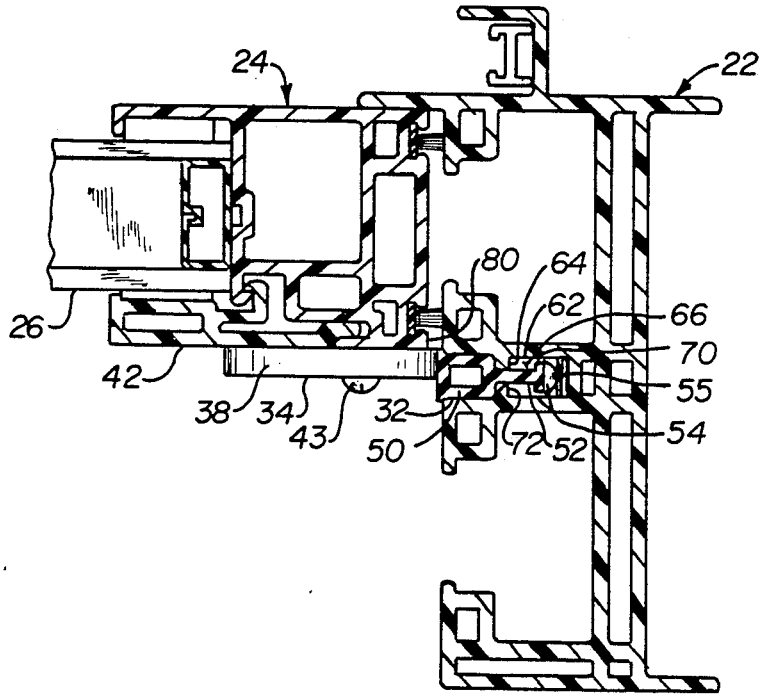
FIG. 4 is a cross-sectional view taken along line 3—3 of FIG. 3.

The parting bead cam 34 is mounted on the inside surface 42 of the window sash 24 as can best be seen in FIGS. 2 and 4. This would correspond to the interior side of the building or house (not shown) in which the window assembly 20 is placed. The parting bead cam 34 is preferably mounted by a screw 43 or other pivot or fastener means about which it is rotatable.

Figure 3:
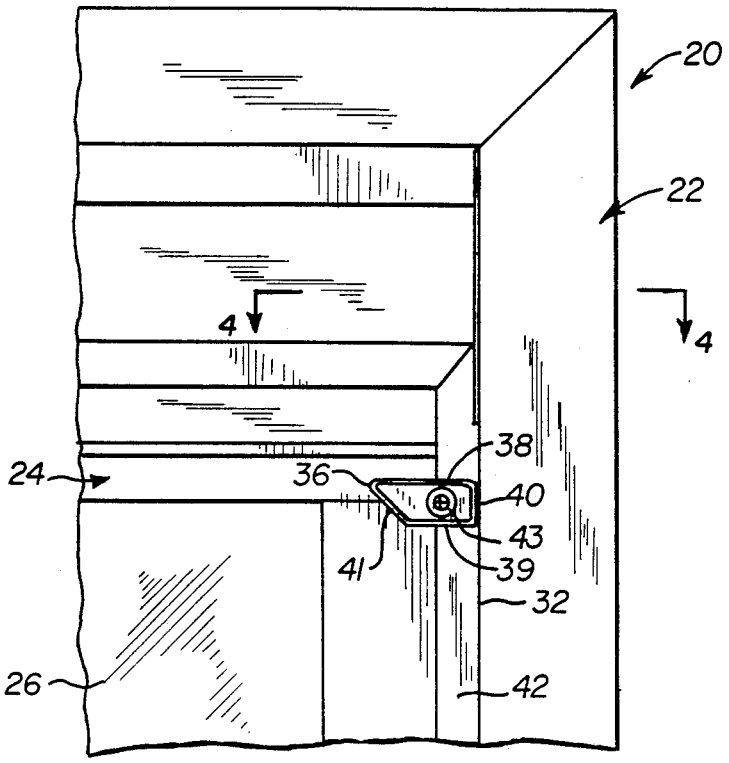
FIG. 3 is a partial front elevational view of the window assembly of FIG. 1 but here showing the parting bead cam of the invention in the depressed position.

As can be seen in FIG. 3, the parting bead cam 34 is designed to be rotated from the "released" position of FIG. 1 to the "depressed" position of FIG. 3.

The parting bead 32 can best be seen in FIGS. 2 and 4. The parting bead 32 consists of a generally rectangular elongated hollow portion 50, an elongated connector portion 52 and an elongated anchor portion 54 which houses a spring 55, which is preferably a coil spring. If desired, a foam-type material can be used to provide the necessary spring action. The parting bead 32 is positioned in an elongated recess 60 formed in the window frame 22. The recess 60 consists of an elongated outer portion 62 in which the hollow portion 50 of the parting bead 32 is received, an elongated tapered throat portion 64 that receives the connector portion 52 and an elongated inner recess 66 that receives the anchor portion 54 of the parting bead 32.

The anchor portion 54 of the parting bead 32 has an elongated lip 70 that is adapted to engage the back portion 72 of the throat portion 64. This lip 72 prevents the anchor portion 54 from moving into the outer portion 62 of the recess 60, which in turn controls the position of the whole parting bead 32.

The coil spring 55 is preferably housed in the anchor portion 54 to compress the parting bead 32 against the window frame 22 or the back portion 72 of the throat portion 64.

Preferably, there is a parting bead and parting bead cam on the left and right vertical window frame elements. The parting bead cam 34 is designed symmetrically so that the same cam can be used on both sides of the window frame.

Referring further to FIGS. 1–4, the "released" and "depressed" positions of the parting bead 32 will be discussed. The "released" position shown in FIG. 1 corresponds to allowing vertical sliding movement of the window sash 24 with respect to the window frame 22. As can be seen in FIG. 2, in the release position, the parting bead cam 34 does not press against the parting bead 32. The parting bead 32 thus engages a portion 80 of the window sash 24, thus preventing the window sash 24 from tilting inwardly and also locking the window sash 24 in a specific vertical position with respect to the frame 22 once the window sash 24 comes to rest in the window frame 22.

Referring particularly to FIG. 4, the "depressed" position of the parting bead cam 34 and parting bead 32 are shown. The parting bead cam 34 is now rotated clockwise about screw or pivot 43. This involves, preferably, rotating the parting bead cam 34 about ninety degrees so that point 36 is pointing to the left in FIG. 3. The parting bead cam 34 pushes the parting bead 32 towards the window frame 22. As can be seen, the entire parting bead 32 is depressed inwardly from the "released" position.

As can be seen in FIG. 4, the parting bead cam 34 depresses the parting bead 32 so that the anchor portion 50 of the parting bead 32 no longer overlaps and interferes with the edge 80 of the sash 24. This action also has two objectives: first, the window sash 24 can now be tilted inwardly to facilitate cleaning of the windows and second, the position of the window sash 24 in the window frame 22 will be securely maintained by the parting bead 32.

It will be appreciated that the window latch construction provides an easy and effective method of providing a window sash that can alternately slide vertically and tilt inwardly with respect to a window frame.

Whereas a particular embodiment of the invention has been described hereinabove for purposes of illustration, it will be evident to those skilled in the art that numerous variations of the details may be made without departing from the invention as defined in the appended claims.

I claim:

1. A window assembly comprising of a window frame having elongated parting bead means mounted therein, a window sash mounted in said window frame, parting bead cam means rotatably mounted on said window sash and being rotatable from a first position to a second position, whereby when said parting bead cam means is in said first position said window cam sash can slide vertically with respect to said window frame and when said parting bead cam means is in said second position said window sash can tilt angularly with respect to said window frame, said parting bead means being positioned in an elongated recess of said window frame, and said parting bead means having an elongated generally rectangular portion, an elongated connector portion, and an elongated anchor portion.

2. The assembly of claim 1, including said recess having an elongated outer portion, an elongated tapered portion, and an elongated inner recess portion.

3. The assembly of claim 2, including said anchor portion having a lip, whereby said lip engages said tapered portion so that the position of said parting bead means can be controlled.

4. The assembly of claim 3, including said inner recess having spring means which engage said elongated anchor portion.

5. A window assembly comprising of a window frame having elongated parting bead means mounted therein, a window sash mounted in said window frame, parting bead cam means rotatable from a first position to a second position, whereby when said parting bead cam means is in said first position said window sash can slide vertically with respect to said window frame and when said parting bead cam means is in said second position said window sash can tilt angularly with respect to said window frame, and said parting bead cam means not being in contact with said parting bead when said parting bead cam means is in said first position.

6. The assembly of claim 5, including said parting bead overlapping a portion of said window sash when said parting bead cam means is in said first position.

7. The assembly of claim 5, including said parting bead cam means providing ready visual determination of whether the parting bead cam means is in its first or second position.

8. The assembly of claim 7, including said parting bead cam means being secured to and rotatable about pivot means.

9. The assembly of claim 8, including said parting bead cam means being generally trapezoidal in shape, having two generally parallel sidewalls, one generally perpendicular endwall and one generally angled endwall joining said parallel sidewalls, said angled sidewall and one of said parallel sidewalls form a point, whereby ready visual observation of said point will allow determination of whether said parting bead cam means is in said first or second position.

10. The assembly of claim 9, including said point pointing in one direction to indicate that said parting bead cam means is in contact with said parting bead and in a second direction to indicate said parting bead cam means is not in contact with said parting bead.

11. A window assembly comprising of a window frame having elongated parting bead means mounted therein, a window sash mounted in said window frame, parting bead cam means rotatably mounted on said window sash and being rotatable from a first position to a second position, whereby when said parting bead cam means is in said first position said window sash can slide vertically with respect to said window frame and when said parting bead cam means is in said second position said window can tilt angularly with respect to said window frame, and said parting bead cam means being in contact with said parting bead when said parting bead cam means is in said second position.

12. The assembly of claim 11, including said parting bead being pressed into said recess when said parting bead cam means is in said second position.

13. The assembly of claim 11, including said parting bead not overlapping a portion of said window sash when said parting bead cam means is in said second position.

* * * * *

UNITED STATES PATENT AND TRADEMARK OFFICE

CERTIFICATE OF CORRECTION

PATENT NO. : 4,869,020

DATED : September 26, 1989

INVENTOR(S) : THOMAS ANDRES

It is certified that error appears in the above-identified patent and that said Letters Patent is hereby corrected as shown below:

Col. 2, line 21, --in the-- should be inserted after "invention".

Claim 1, col. 4, line 18, "cam" should be deleted.

Claim 5, col. 4, line 43, after "cam" the following should be inserted: --means rotatably mounted on said window sash and being--.

Claim 11, col. 6, line 5, --sash-- should be inserted before "can".

Signed and Sealed this

Twenty-fifth Day of December, 1990

*Attest:*

HARRY F. MANBECK, JR.

*Attesting Officer*

*Commissioner of Patents and Trademarks*